US009804552B2

(12) United States Patent
Tano et al.

(10) Patent No.: US 9,804,552 B2
(45) Date of Patent: Oct. 31, 2017

(54) CLEANING BLADE, PROCESS CARTRIDGE, AND IMAGE FORMING APPARATUS

(71) Applicant: FUJI XEROX CO., LTD., Tokyo (JP)

(72) Inventors: Daisuke Tano, Kanagawa (JP); Yu Nakamura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/230,985

(22) Filed: Aug. 8, 2016

(65) Prior Publication Data

US 2017/0285553 A1 Oct. 5, 2017

(30) Foreign Application Priority Data

Mar. 29, 2016 (JP) ..... 2016-065646

(51) Int. Cl.
*G03G 21/00* (2006.01)
*G03G 21/18* (2006.01)

(52) U.S. Cl.
CPC ..... *G03G 21/0017* (2013.01); *G03G 21/18* (2013.01)

(58) Field of Classification Search
CPC combination set(s) only.
See application file for complete search history.

(56) References Cited

U.S. PATENT DOCUMENTS 4,779,119 A * 10/1988 Kaieda ..... G03G 21/0011 15/256.5
5,138,395 A * 8/1992 Lindblad ..... G03G 21/0017 15/256.5
2016/0004207 A1* 1/2016 Sakaguchi ..... G03G 21/0017 399/350

FOREIGN PATENT DOCUMENTS

JP 5-119676 A 5/1993

* cited by examiner

*Primary Examiner* — Clayton E Laballe
*Assistant Examiner* — Jas Sanghera
(74) *Attorney, Agent, or Firm* — Sughrue Mion, PLLC

(57) ABSTRACT

A cleaning blade that contacts a cleaning target member having a cleaning target surface which moves, and cleans the cleaning target surface, includes a blade body; and a blade protrusion that is present at an end portion of a lower surface of the blade body near a distal end surface of the blade body, has a shape protruding outward in a thickness direction with respect to the lower surface, and has an inclined surface being a surface continued from the distal end surface and inclined outward in the thickness direction with respect to the lower surface and inward in a height direction with respect to the distal end surface from an end of the distal end surface near the lower surface. At least a portion of the incline surface is a contact surface that contacts the cleaning target member.

19 Claims, 11 Drawing Sheets

CLEANING BLADE, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2016-065646 filed Mar. 29, 2016.

BACKGROUND

The present invention relates to a cleaning blade, a process cartridge, and an image forming apparatus.

SUMMARY

According to an aspect of the invention, there is provided a cleaning blade that contacts a cleaning target member having a cleaning target surface which moves, and cleans the cleaning target surface, including a blade body having a distal end surface facing an upstream side in a direction of the movement in a state where the cleaning blade is in contact with the cleaning target member, a lower surface facing a downstream side in the direction of the movement in the state where the cleaning blade is in contact with the cleaning target member, an upper surface sharing a side with the distal end surface and opposed to the lower surface, and a pair of side surfaces each sharing sides respectively with the distal end surface, the lower surface, and the upper surface; and a blade protrusion that, when a direction in which the pair of side surfaces are opposed is a width direction, a direction in which the lower surface and the upper surface are opposed is a thickness direction, and a direction orthogonal to the width direction and the thickness direction is a height direction, is present at an end portion of the lower surface near the distal end surface, has a shape protruding outward in the thickness direction with respect to the lower surface, and has an inclined surface being a surface continued from the distal end surface and inclined outward in the thickness direction with respect to the lower surface and inward in the height direction with respect to the distal end surface from an end of the distal end surface near the lower surface. At least a portion of the incline surface is a contact surface that contacts the cleaning target member.

BRIEF DESCRIPTION OF THE DRAWINGS

An exemplary embodiment of the present invention will be described in detail based on the following figures, wherein.

DETAILED DESCRIPTION

A cleaning blade, a cleaning device, a process cartridge, and an image forming apparatus according to an exemplary embodiment of the invention are described below in detail.

Cleaning Blade

A cleaning blade according to this exemplary embodiment contacts a cleaning target member having a cleaning target surface which moves, and cleans the surface of the cleaning target member.

The cleaning blade according to this exemplary embodiment is described with reference to the drawings.

Figure 1:
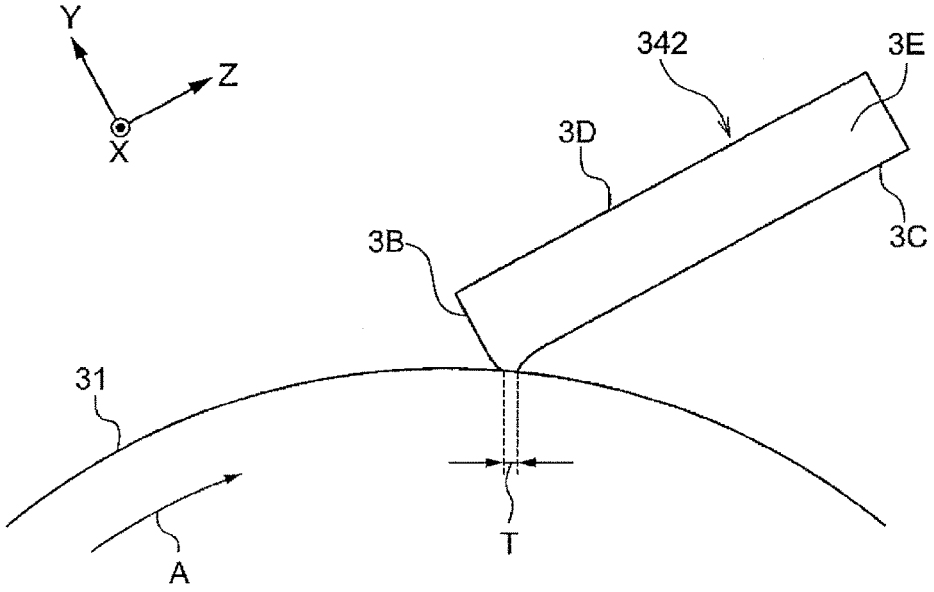
FIG. 1 is a schematic illustration viewed from a side surface showing a state where a cleaning blade according to this exemplary embodiment is in contact with a cleaning target member having a cleaning target surface which moves.
Figure 2:
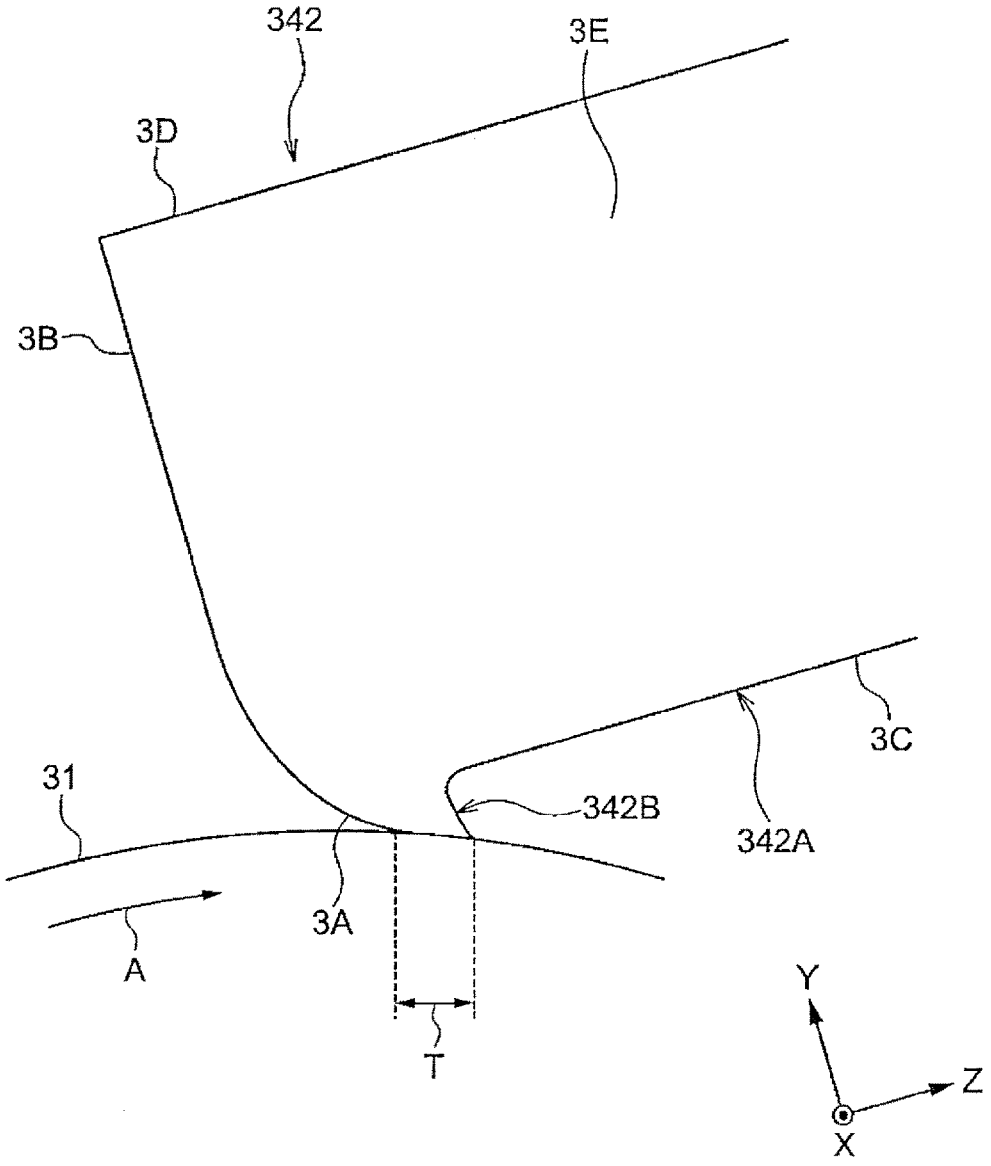
FIG. 2 is an enlarged view from the side surface showing, in an enlarged manner, a contact portion of the cleaning blade according to this exemplary embodiment with the cleaning target member.

FIG. 1 illustrates a cleaning blade 342 arranged to be in contact with a surface of a cleaning target member 31. FIG. 2 illustrates a contact portion between the cleaning target member 31 and the cleaning blade 342 in an enlarged manner. FIGS. 1 and 2 illustrate a state where the cleaning target member 31 is rotationally driven and hence the cleaning target surface moves. Also, FIG. 3 is a perspective view showing a portion of the cleaning blade 342 in a state where the cleaning blade 342 is not in contact with the cleaning target member 31, that is, in a state where a load by friction with the cleaning target member 31 is not applied.

First, respective portions of the cleaning blade 342 are described.

Figure 3:
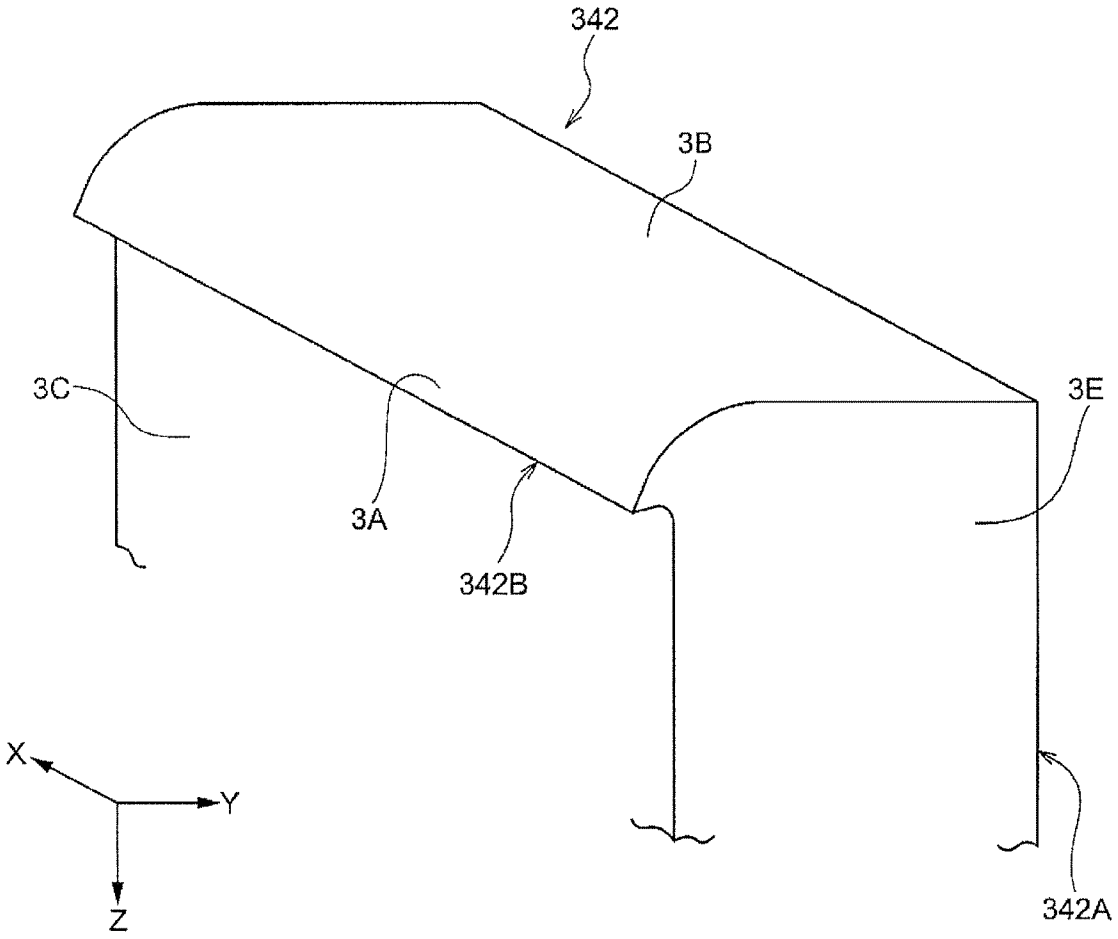
FIG. 3 is a schematic perspective view showing a portion of the cleaning blade according to this exemplary embodiment in a state where the cleaning blade is not in contact with the cleaning target member.

As illustrated in FIGS. 1 to 3, the cleaning blade 342 includes a blade body 342A and a blade protrusion 342B.

The blade body 342A has a distal end surface 3B facing an upstream side in a direction (a direction indicated by arrow A) in which the cleaning target surface of the cleaning target member 31 moves in a state where the cleaning blade 342 is in contact with the cleaning target member 31; a lower surface 3C facing a downstream side in the movement direction (the arrow A direction) in the state where the cleaning blade 342 is in contact with the cleaning target member 31; an upper surface 3D sharing a side with the distal end surface 3B and opposed to the lower surface 3C; and a pair of side surfaces 3E each sharing sides respectively with the distal end surface 3B, the lower surface 3C, and the upper surface 3D.

In this blade body 342A, it is assumed that a direction in which the pair of side surfaces 3E are opposed, that is, a paper depth direction in FIGS. 1 and 2 and a direction indicated by arrow X in FIG. 3 represent a width direction X; a direction in which the lower surface 3C and the upper surface 3D are opposed, that is, a direction indicated by arrow Y in FIGS. 1 to 3 represents a thickness direction Y; and a direction orthogonal to the width direction X and the thickness direction Y, that is, a direction indicated by arrow Z in FIGS. 1 to 3 represents a height direction Z.

The blade protrusion 342B is present at an end portion of the lower surface 3C of the blade body 342A near the distal end surface 3B. The blade protrusion 342B has a shape protruding outward in the thickness direction Y with respect to the lower surface 3C of the blade body 342A. The blade protrusion 342B has an inclined surface 3A. This inclined surface 3A is an inclined surface being a surface continued from the distal end surface 3B of the blade body 342A, and inclined outward in the thickness direction Y with respect to the lower surface 3C and inward in the height direction Z with respect to the distal end surface 3B from an end of the distal end surface 3B near the lower surface 3C.

In the cleaning blade 342 according to this exemplary embodiment, at least a portion of the inclined surface 3A of the blade protrusion 342B is a contact surface forming a contact region T with the cleaning target member 31.

According to this exemplary embodiment, with the aforementioned configuration, since the cleaning blade has the above-described configuration, the cleaning blade that may decrease wear is provided.

The reason that this effect is attained may be considered as follows.

Figure 13:
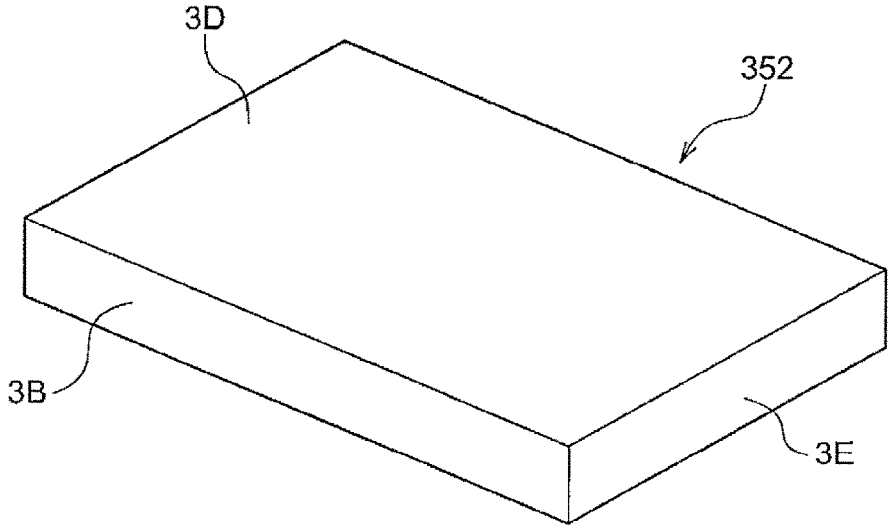
FIG. 13 RELATED ART
FIG. 13 schematically illustrates a cleaning blade according to related art in a state where the cleaning blade is not in contact with a cleaning target member.
Figure 14:
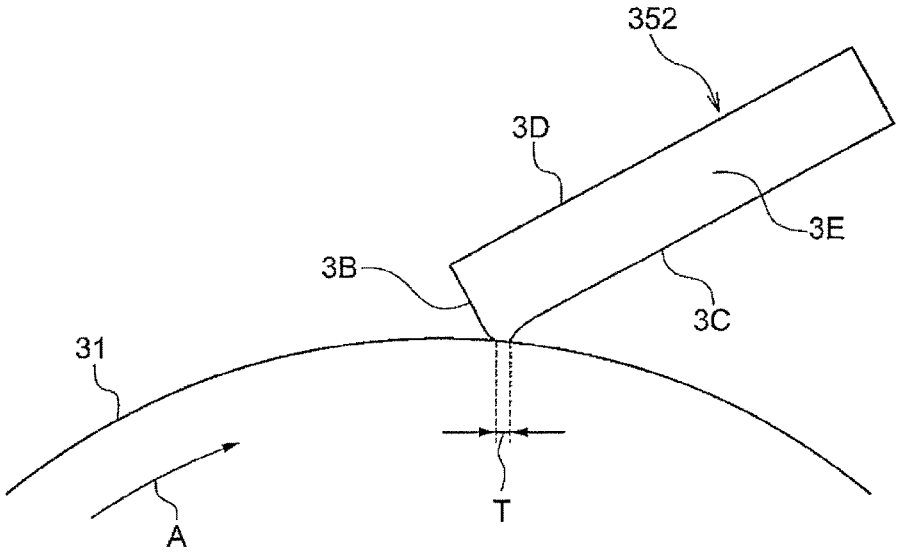
FIG. 14 RELATED ART
FIG. 14 schematically illustrates a state where the cleaning blade according to related art is in contact with a cleaning target member having a cleaning target surface which moves.

As a cleaning blade of related art, a cleaning blade 352 having a rectangular-parallelepiped shape as illustrated in FIG. 13 and formed of an elastic material is typically used. As shown in FIG. 14, the cleaning blade 352 having the rectangular-parallelepiped shape is arranged so that an edge formed by a distal end surface 3B and a lower surface 3C comes into contact with a cleaning target member 31. As a cleaning target surface moves because the cleaning target member 31 is rotationally driven, friction occurs between the cleaning blade 352 and the cleaning target member 31, and the cleaning blade 352 is deformed in the movement direction of the cleaning target surface (the arrow A direction) by the load of this friction. Hence, a portion of the distal end surface 3B near the edge defines a contact surface forming a contact region T with the cleaning target member 31. Cleaning is provided by sliding between this contact surface and the surface of the cleaning target member 31. With this method, since the elastic cleaning blade 352 is forcedly deformed in the movement direction (the arrow A direction) by the friction against the cleaning target member 31, repetitive small vibration (so-called stick-slip vibration) continuously occurs at the edge portion of the cleaning blade 352 while the cleaning blade 352 slides on the cleaning target member 31.

As described above, when the cleaning blade 352 having the rectangular-parallelepiped shape is used, since the cleaning blade 352 is pressed with a so high pressure that the edge is deformed in the movement direction (the arrow A direction), a strong friction force is generated at the contact portion of the cleaning blade 352. Also, since the repetitive small vibration (the stick-slip vibration) is continued as described above while the cleaning blade 352 slides on the cleaning target member 31, the load due to this vibration is also applied to the edge of the cleaning blade 352, and as the result the contact portion wears.

In contrast, in this exemplary embodiment, as shown in FIGS. 1 to 3, the cleaning blade 342 has the blade protrusion 342B, and the blade protrusion 342B has the inclined surface 3A that is inclined outward in the thickness direction Y with respect to the lower surface 3C and inward in the height direction Z with respect to the distal end surface 3B from the end of the distal end surface 3B near the lower surface 3C. The cleaning blade 342 is arranged so that at least the portion of the inclined surface 3A extends along the surface of the cleaning target member 31 and is brought into contact with the cleaning target member 31, and hence at least the portion of the inclined surface 3A forms the contact region T. Accordingly, as compared with the use of the cleaning blade 352 having the rectangular-parallelepiped shape, cleaning may be provided even by pressing the cleaning blade 342 to the cleaning target member 31 with a smaller pressure than that of the cleaning blade 352. Owing to this, the friction force generated between the cleaning blade 342 and the cleaning target member 31 is decreased while high cleaning performance is provided. Also, since the pressing force of the cleaning blade 342 to the cleaning target member 31 may be decreased, the repetitive small vibration (the stick-slip vibration) at the contact portion between the cleaning blade 342 and the cleaning target member 31 is also decreased, and the load applied to the cleaning blade 342 is decreased. As the result, wear of the cleaning blade 342 may be decreased.

Also, since the friction force between the cleaning blade 342 and the cleaning target member 31 may be decreased and the load due to the stick-slip vibration may be decreased while the high cleaning performance is provided, wear of the surface of the cleaning target member 31 is decreased.

Further, according to this exemplary embodiment, the contact surface between the cleaning blade 342 and the cleaning target member 31 may be formed unlike the cleaning blade 352 having the rectangular-parallelepiped shape in which the contact portion between the cleaning blade 352 and the cleaning target member 31 is deformed in the movement direction (the arrow A direction). Hence, the cleaning blade 342 according to this exemplary embodiment does not have to have the elasticity that is required for the cleaning blade 352 having the rectangular-parallelepiped shape of related art. That is, the degree of freedom is increased for the selection of the material.

As the result, in this exemplary embodiment, the cleaning blade 342 may use a material with a higher hardness, which hardly wears and which hardly generates the repetitive small vibration (the stick-slip vibration), or a lower friction coefficient than the material used for the cleaning blade 352 having the rectangular-parallelepiped shape of related art.

Accordingly, wear of the cleaning blade 342 may be decreased also in these viewpoints.

Next, a configuration of the cleaning blade according to this exemplary embodiment is described in detail.

FIGS. 1 to 3 shows an example of the cleaning blade according to this exemplary embodiment.

FIG. 1 schematically illustrates the cleaning blade 342 being in contact with the cleaning target member 31 having the cleaning target surface which moves when rotationally driven. FIG. 2 is an enlarged view of the contact portion between the cleaning target member 31 and the cleaning blade 342 shown in FIG. 1. FIG. 3 is a perspective view showing a portion of the blade body 342A of the cleaning blade 342 near the distal end surface 3B in the state where the cleaning blade 342 is not in contact with the cleaning target member 31, and the blade protrusion 342B.

The cleaning blade 342 has the blade body 342A and the blade protrusion 342B. It is desirable to integrally seamlessly form the blade body 342A and the blade protrusion 342B by using the same material.

The boundary between the blade body 342A and the blade protrusion 342B is defined with reference to the lower surface 3C in the thickness Y direction. That is, the inner side in the thickness direction Y with respect to the lower surface 3C is called blade body 342A, and the outer side in the thickness direction Y with respect to the lower surface 3C is called blade protrusion 342B.

Blade Protrusion

The blade protrusion 342B protrudes outward in the thickness direction Y with respect to the lower surface 3C, at the end portion of the lower surface 3C of the blade body 342A near the distal end surface 3B. The blade protrusion 342B has the inclined surface 3A that is a surface continued from the distal end surface 3B of the blade body 342A. At least a portion of the inclined surface 3A forms the contact region T with the cleaning target member 31. The inclined surface 3A is inclined outward in the thickness direction Y with respect to the lower surface 3C and inward in the height direction Z with respect to the distal end surface 3B from the end of the distal end surface 3B of the blade body 342A near the lower surface 3C. That is, the inclined surface 3A is inclined along the movement direction (the arrow A direction) of the cleaning target surface when brought into contact with the cleaning target member 31. Hence, the inclined surface 3A faces the upstream side in the movement direction (the arrow A direction) with respect to the lower surface 3C.

The length of a region forming the contact region T with the cleaning target member 31 (that is, a contact surface) in the inclined surface 3A is preferably in a range from 10 μm to 60 μm or a range from about 10 μm to about 60 μm, as the length in the movement direction of the cleaning target surface (the arrow A direction). As long as the length of the contact surface is 10 μm or larger, the surface that slides on the cleaning target member 31 is increased, and high cleaning performance may be provided. Also, as long as the length of the contact surface is 60 μm or smaller, the area of the surface that slides on the cleaning target member 31 is decreased, and wear of the surface of the cleaning target member 31 may be decreased while the high cleaning performance is provided.

The length of the contact surface of the inclined surface 3A in the movement direction of the cleaning target surface (the arrow A direction) is more preferably in a range from 10 μm to 50 μm or a range from about 10 μm to about 50 μm, and further preferably in a range from 10 μm to 40 μm or a range from about 10 μm to about 40 μm.

Modifications

The contact surface of the inclined surface 3A may be a flat surface or a curved surface. That is, like a cleaning blade 3422 shown in FIG. 4, a contact surface 3S, which contacts the cleaning target member, of the inclined surface 3A may be flat. Alternatively, like a cleaning blade 3424 shown in FIG. 5, a contact surface 3S, which contacts the cleaning target member, of the inclined surface 3A may be curved.

Figure 4:
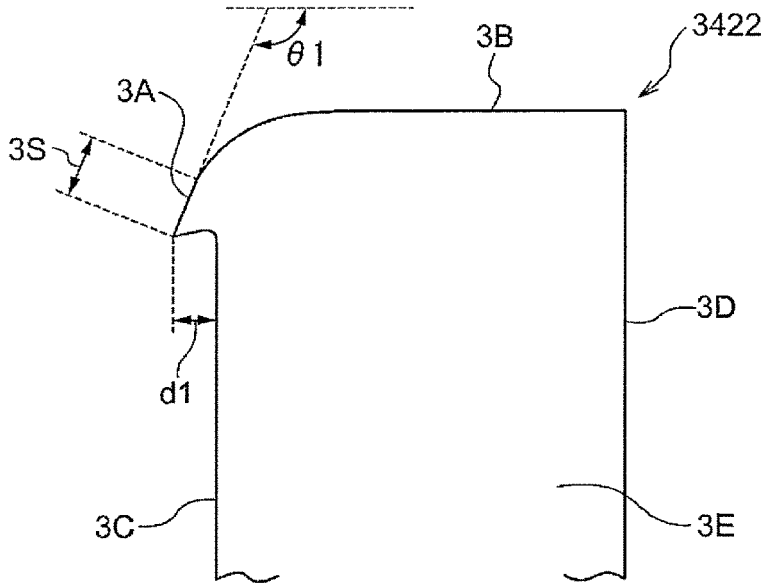
FIG. 4 is a schematic illustration viewed from the side surface showing a modification of the cleaning blade according to this exemplary embodiment in the state where the cleaning blade is not in contact with the cleaning target member.

However, the contact surface desirably has a shape extending along the shape of the cleaning target surface of the cleaning target member 31 to decrease wear of the contact surface 3S while providing the high cleaning performance. Hence, if the surface of the cleaning target surface of the cleaning target member 31 is curved, the contact surface 3S is desirably a curved surface having a curvature radius corresponding to the curvature radius of the cleaning target surface. Also, if the cleaning target surface is flat, the portion that defines the contact surface 3S is also desirably flat as shown in FIG. 4.

Figure 6:
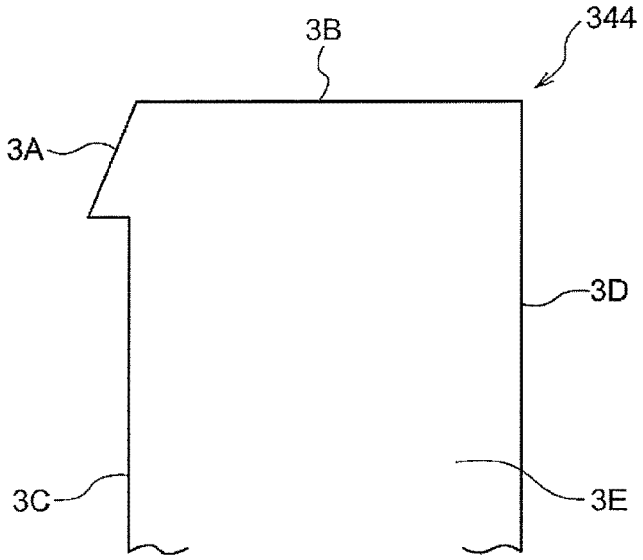
FIG. 6 is a schematic illustration viewed from the side surface showing a modification of the cleaning blade according to this exemplary embodiment in the state where the cleaning blade is not in contact with the cleaning target member.

Also, in the cleaning blade 342 shown in FIGS. 2 and 3, a connection portion between the inclined surface 3A and the distal end surface 3B has a smoothly continuous form using a curved surface. However, this exemplary embodiment is not limited to this form. For example, like a cleaning blade 344 shown in FIG. 6, the connection portion between the inclined surface 3A and the distal end surface 3B may have a continuous form with an edge interposed therebetween.

Figure 5:
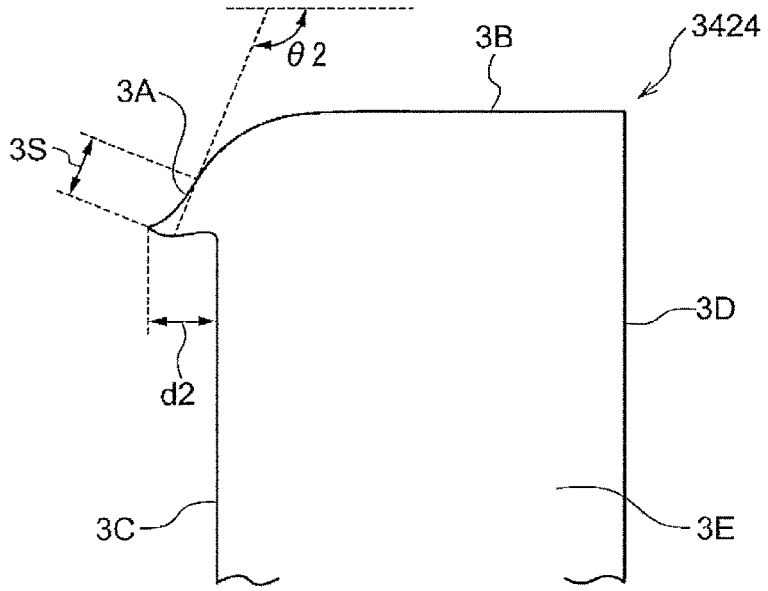
FIG. 5 is a schematic illustration viewed from the side surface showing a modification of the cleaning blade according to this exemplary embodiment in the state where the cleaning blade is not in contact with the cleaning target member.

Two cases (a) and (b) may be conceived for the angle of the contact surface with respect to the thickness direction as follows. That is, (a) when the contact surface 3S is a flat surface as shown in FIG. 4, the angle of the contact surface 3S with respect to the thickness direction Y is an angle θ1. Also, (b) when the contact surface 3S is a curved surface as shown in FIG. 5, the cleaning target surface of the cleaning target member 31 is a curved surface, and the contact surface 3S is a curved surface having a curvature radius corresponding to the curvature radius of the cleaning target surface, a line (a tangent) being in contact with the cleaning target surface at the end near the distal end surface 3B of the region where the contact surface 3S contacts the cleaning target surface is plotted, and the angle of the tangent with respect to the thickness direction Y is an angle θ2. Each angle is preferably in a range from 95° to 140° or a range from about 95° to about 140°.

As long as each angle is in the range, a cleaning object present on the surface of the cleaning target member 31 (for example, if the cleaning target member 31 is an image holding body in an image forming apparatus, an image forming material such as a toner) is properly blocked at the upstream side in the movement direction (the arrow A direction) of the contact region T, and high cleaning performance may be provided. Also, since the cleaning object is properly blocked, formation of a deposit of the cleaning object at the upstream side in the movement direction of the contact region T (if the cleaning object is a toner, a toner gathering spot (so-called toner dam)) due to deposition of the toner is increased, and also in this viewpoint, the high cleaning performance may be provided.

The angle of the contact surface 3S with respect to the thickness direction is more preferably in a range from 100° to 135° or a range from about 100° to about 135°, and further preferably in a range from 105° to 130° or a range from about 105° to about 130°.

Figure 7:
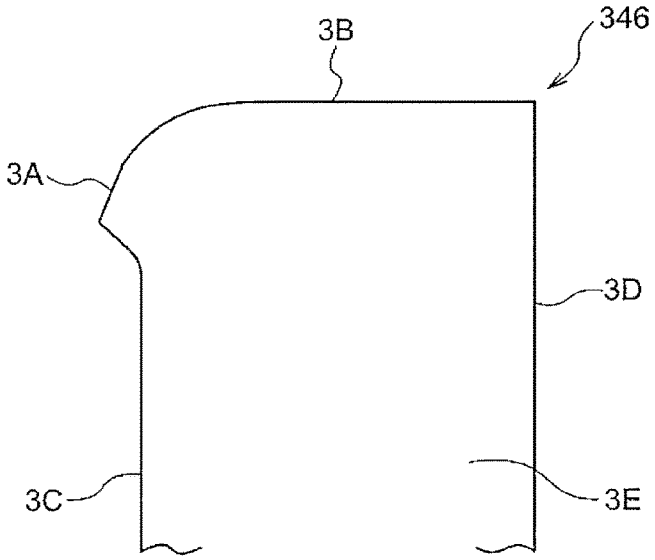
FIG. 7 is a schematic illustration viewed from the side surface showing a modification of the cleaning blade according to this exemplary embodiment in the state where the cleaning blade is not in contact with the cleaning target member.

The blade protrusion 342B of the cleaning blade 342 shown in FIGS. 2 and 3 has a form with a shape in which an end portion of the inclined surface 3A opposite to the distal end surface 3B is acutely bent toward the lower surface 3C, that is, a shape having an acute angle (an angle smaller than 90'). However, this exemplary embodiment is not limited to this form. For example, like a cleaning blade 346 shown in FIG. 7, a shape in which the end portion of the inclined surface 3A opposite to the distal end surface 3B is obtusely bent toward the lower surface 3C, that is, a shape having an obtuse angle (an angle larger than 90°), or a shape bent at a right angle toward the lower surface 3C, that is, a shape having a right angle (an angle of 90°) may be employed.

Figure 8:
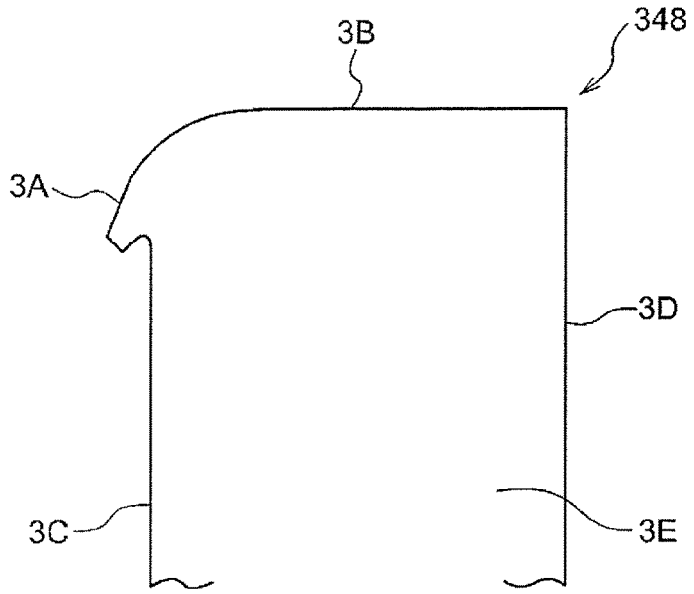
FIG. 8 is a schematic illustration viewed from the side surface showing a modification of the cleaning blade according to this exemplary embodiment in the state where the cleaning blade is not in contact with the cleaning target member.
Figure 9:
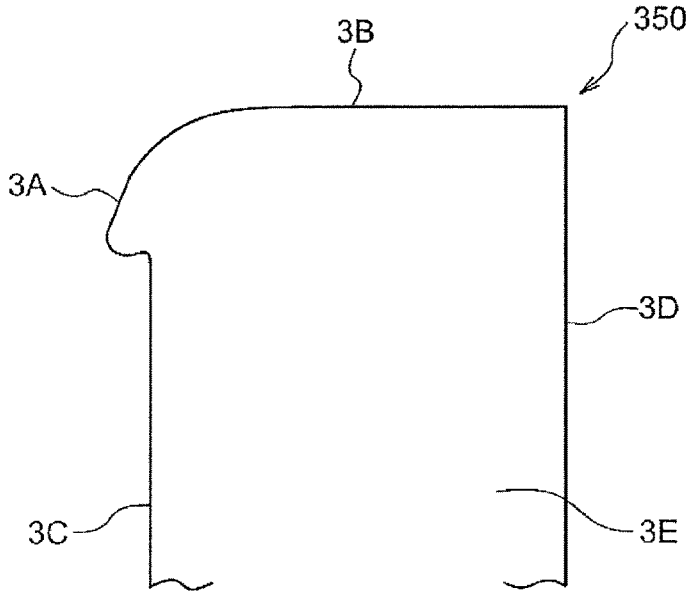
FIG. 9 is a schematic illustration viewed from the side surface showing a modification of the cleaning blade according to this exemplary embodiment in the state where the cleaning blade is not in contact with the cleaning target member.

Further, the shape of the end portion of the inclined surface 3A opposite to the distal end surface 3B may employ other form. For example, like a cleaning blade 348 shown in FIG. 8, a shape in which the end portion is bent two or more times toward the lower surface 3C, that is, a shape having two or more edges may be employed. Also, like a cleaning blade 350 shown in FIG. 9, a shape of a curved surface smoothly continued from the inclined surface 3A to the lower surface 3C, that is, a shape having no edge and connected by a curved surface may be employed.

When the end portion of the inclined surface 3A opposite to the distal end surface 3B has a shape bent toward the lower surface 3C, that is, a shape having at least one edge (for example, any one of the shapes shown in FIGS. 2, 3, 6, 7, and 8), the angle of the edge present at the end portion of the inclined surface 3A opposite to the distal end surface 3B is preferably 10° or larger. As long as the angle is 10° or larger, the strength of the blade protrusion 342B is increased, the cleaning blade is properly pressed to the cleaning target member 31, and as the result high cleaning performance may be provided.

The angle of the edge present at the end portion of the inclined surface 3A opposite to the distal end surface 3B is more preferably 12° or larger, and further preferably 15° or larger. The upper limit value of the angle is not particularly limited; however, the upper limit value is preferably 30° or smaller, and more preferably 25° or smaller.

The largest distance between the inclined surface 3A and the lower surface 3C, that is, the distance from the end portion of the inclined surface 3A opposite to the distal end surface 3B to the lower surface 3C (a distance d1 shown in FIG. 4 or a distance d2 shown in FIG. 5) is preferably 20 μm or smaller, more preferably 10 μm or smaller, and further preferably 5 μm or smaller, in a viewpoint to increase the strength of the blade protrusion 342B, properly press the cleaning blade to the cleaning target member 31, and hence to provide high cleaning performance. Also, the lower limit value of the distance is preferably 0.1 μm or larger, more preferably 0.5 μm or larger, and further preferably 1 μm or larger in a viewpoint to properly form the blade protrusion 342B.

Blade Body

The blade body 342A has a distal end surface 3B facing an upstream side in a direction (a direction indicated by arrow A) in which a cleaning target surface of the cleaning target member 31 moves in a state where the cleaning blade 342 is in contact with the cleaning target member 31; a lower surface 3C facing a downstream side in the movement direction (the arrow A direction) in the state where the cleaning blade 342 is in contact with the cleaning target member 31; an upper surface 3D sharing a side with the distal end surface 3B and opposed to the lower surface 3C; and a pair of side surfaces 3E each sharing sides respectively with the distal end surface 3B, the lower surface 3C, and the upper surface 3D.

The distal end surface 3B, the lower surface 3C, the upper surface 3D, and the pair of side surfaces 3E desirably have flat surfaces. Further, the shape of a portion of the cleaning blade 342 except the blade protrusion 342B is desirably a rectangular-parallelepiped shape. However, it is not limited thereto. The distal end surface 3B, the lower surface 3C, the upper surface 3D, and the pair of side surfaces 3E may be curved surfaces or uneven surfaces.

Also, the blade body 342A desirably has a shape that does not contact the cleaning target member 31. That is, only at least a portion of the inclined surface 3A of the blade protrusion 342B desirably contacts the cleaning target member 31.

Material

Next, material of the cleaning blade according to this exemplary embodiment is described.

The entirety including the blade body and the blade protrusion of any of the cleaning blade 342 shown in FIGS. 1 to 3, and the cleaning blades 3422, 3424, 344, 346, 348, and 350 shown in FIGS. 4 to 9 is formed of a single material.

However, this exemplary embodiment is not limited thereto. The cleaning blade may have a layered configuration including two or more layers. For example, a section at the lower surface 3C side and a section at the upper surface 3D side of the blade body may be formed of different materials. For example, the cleaning blade may employ a form having a two-layer configuration including a layer at the upper surface 3D side and a layer at the lower surface 3C side including the blade protrusion, which are formed of different materials.

The material forming the cleaning blade according to this exemplary embodiment is desirably a resin composition containing thermoplastic resin as a major component.

In this case, being a major component represents preferably occupying 50 weight % or more in the resin composition, more preferably occupying 80 weight % or more, further preferably occupying 90 weight % or more, and still further preferably occupying 100 weight %.

The resin composition may contain a known additive in addition to the thermoplastic resin.

The thermoplastic resin is desirably crystalline resin in a viewpoint of formability, wear resistance, sliding characteristic, and rigidity. The crystalline resin may be, for example, polyacetal (POM), polypropylene (PP), polyethylene (PE), polyamide (PA), polybutylene terephthalate (PBT), polyethylene terephthalate (PET), polyphenylene sulfide (PPS), polyether etherketone (PEEK), liquid crystal polymer (LCP), and fluorocarbon resin (for example, polytetrafluoroethylene (PTFE), perfluoroalkoxy alkane (PFA)).

For the material forming the cleaning blade according to this exemplary embodiment, a material conventionally used for a cleaning blade may be employed. For example, the material may be polyurethane (for example, a polyurethane obtained by polymerizing polyisocyanate and polyol), silicon rubber, butadiene rubber, etc.

Among these materials, in the viewpoints of wear resistance and sliding characteristic, polyacetal, polyphenylene sulfide, polyether etherketone, and liquid crystal polymer are more desirable. In a viewpoint of easy availability, polyacetal is further desirable.

Manufacturing of Cleaning Blade

The cleaning blade made of a single material shown in FIGS. 1 to 3 is manufactured by, for example, the following method. In a case where the cleaning blade is formed of thermoplastic resin, the thermoplastic resin, which is heated and molten, is injected into a mold having an injection space corresponding to the shape shown in FIGS. 1 to 3 by extrusion molding using an injection molding machine or the like, then is cooled and solidified, and is removed from the mold. Thus, the cleaning blade is manufactured.

In a case of a cleaning blade with a plural-layer configuration, for example, including two layers of a layer at the upper surface 3D side and a layer at the lower surface 3C side including the blade protrusion, the first layer and the second layer (if a configuration includes three or more layers, plural layers) are bonded to one another. Thus, the cleaning blade is manufactured. The bonding method may use any one of various adhesives, a double-faced tape, etc. Alternatively, the plural layers may be bonded by injecting materials of respective layers into a mold with a time lag during molding, and coupling the materials to one another without an adhesive layer.

Properties

Elasticity Modulus

The cleaning blade according to this exemplary embodiment has, as an index of elasticity, a tensile modulus preferably in a range from 20 MPa to 4000 MPa, more preferably in a range from 40 MPa to 3000 MPa, and further preferably in a range from 60 MPa to 2500 MPa.

As long as the tensile modulus is 20 MPa or higher, the hardness is increased, and the wear resistance is increased.

In this case, the tensile modulus is measured for a strip-shaped test piece (6-mm width, 130-mm length, dumbbell No. 1) in conformity with JIS K7161 by Instron 5566 (manufactured by Toyo Seiki Seisaku-sho, Ltd.) under conditions of the test speed: 500 mm/minute and the number of measurements n=5.

Dynamical Friction Coefficient μ

The cleaning blade according to this exemplary embodiment has a dynamical friction coefficient μ (measurement object: polyethylene terephthalate (PET)) preferably in a range from 0.005 to 0.5, more preferably in a range from 0.01 to 0.3, and further preferably in a range from 0.01 to 0.2.

As long as the dynamical friction coefficient μ to PET is 0.5 or smaller, the friction force with respect to the cleaning target member is decreased, and hence the wear resistance is increased. Also, as long as the dynamical friction coefficient μ is 0.005 or larger, the sliding characteristic with respect to the cleaning target member is obtained, and hence the high cleaning performance is provided.

In this case, the dynamical friction coefficient μ is measured as follows.

First, a 10×10 mm slice is cut from the cleaning blade, and the slice serves as a measurement sample. Then, with use of HEiDON TriboGear TYPE: 14 manufactured by Shinto Scientific Co., Ltd., the measurement sample (the cleaning blade) being the 10×10 mm slice is placed to have an angle of 25° at a contact position with a polyethylene terephthalate (PET) sheet (product name: Teijin Tetoron Film manufactured by Teijin DuPont Films Japan Limited) being a measurement object, a load of 40 gf is applied to the measurement sample in the vertical direction, and the measurement sample is pulled at a speed of 60 mm/s.

The friction force acting at pulling is measured by a load cell arranged at a pull portion, an average value for five seconds, in a state where the operation becomes stable after the operation is started, serves as a dynamical friction force, and a value obtained by dividing the dynamical friction force by the load serves as a dynamical friction coefficient μ.

Purpose of Use

If a case where the cleaning blade according to this exemplary embodiment is used and cleans a cleaning target member, the cleaning target member being a cleaning target is not particularly limited as long as it is a member having a surface required to be cleaned. For example, in a case of use in an image forming apparatus, the cleaning object may be an image holding body, an intermediate transfer body, a charging roller, a transfer roller, a transferred-material transport belt, or a paper transport roller. In addition, the cleaning object may be a detoning roller that removes a toner from a cleaning brush that removes the toner from an image holding body. In this exemplary embodiment, the cleaning object is desirably an image holding body.

Cleaning Device, Process Cartridge, and Image Forming Apparatus

Next, a cleaning device, a process cartridge, and an image forming apparatus using the cleaning blade according to this exemplary embodiment are described.

The cleaning device according to this exemplary embodiment is not particularly limited as long as the cleaning device includes the cleaning blade according to this exemplary embodiment as the cleaning blade that contacts the surface of the cleaning target member and cleans the surface of the cleaning target member. A configuration example of the cleaning device may be a configuration in which the cleaning blade is fixed in a cleaning case having an opening near the cleaning target member so that the contact surface of the inclined surface of the blade protrusion is located near the opening. The configuration includes a transport member that guides a foreign substance such as a waste toner collected from the surface of the cleaning target member by the cleaning blade to a foreign substance collecting container. Also, the cleaning device according to this exemplary embodiment may use two or more cleaning blades according to this exemplary embodiment.

The process cartridge according to this exemplary embodiment is not particularly limited as long as the process cartridge includes the image holding body, and the cleaning device according to this exemplary embodiment, as the cleaning device that contacts the surface of at least one cleaning target member, such as the image holding body and cleans the surface of the cleaning target member. For example, a form may be exemplified, which includes the image holding body and the cleaning device according to this exemplary embodiment that cleans the surface of the image holding body, and which is removably mounted on the image forming apparatus. For example, in a case of a tandem machine including image holding bodies corresponding to toners of respective colors, the cleaning device according to this exemplary embodiment may be provided for each of the image holding bodies. In addition, a cleaning brush or the like may be used in addition to the cleaning device according to this exemplary embodiment.

Pressing Force NF

The pressing force NF (normal force) with which the cleaning blade according to this exemplary embodiment is pressed to the cleaning target member is preferably in a range from 1.0 gf/mm to 2.0 gf/mm, more preferably in a range from 1.1 gf/mm to 1.8 gf/mm, and further preferably in a range from 1.3 gf/mm to 1.6 gf/mm in viewpoints to provide high cleaning performance for the cleaning object (for example, the toner) and to decrease wear of the cleaning blade.

Figure 12:
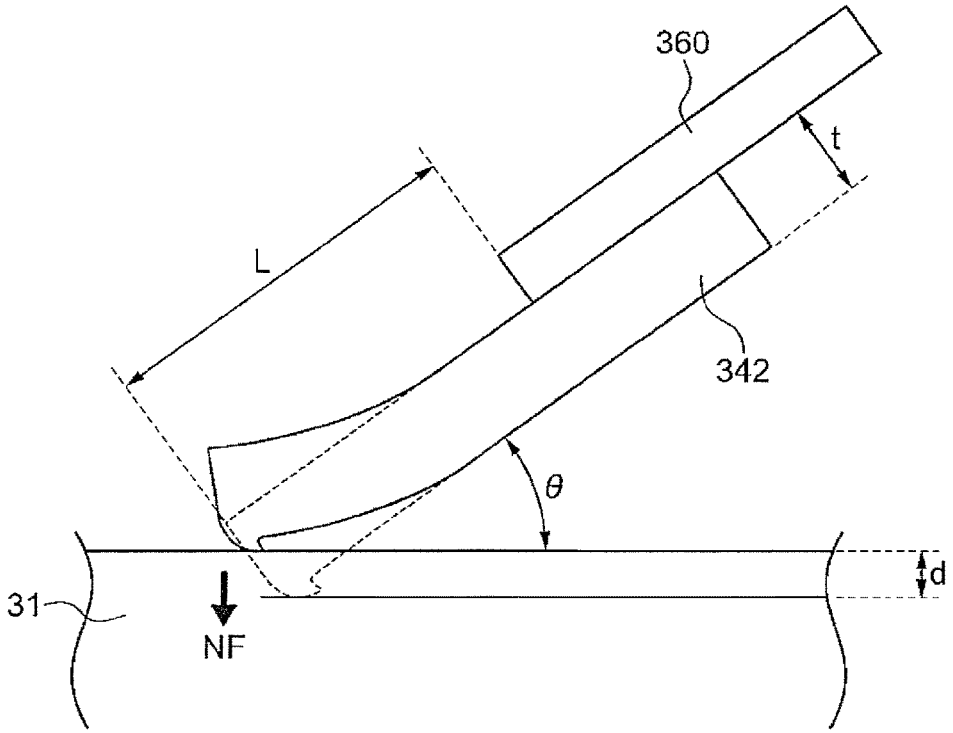
FIG. 12 schematically illustrates the state where the cleaning blade according to this exemplary embodiment is in contact with the cleaning target member.

In this case, the pressing force NF of the cleaning blade is calculated by an expression as follows:

$$NF=dEt^3/4L^3,$$

where d is a depression amount of the cleaning blade 342 shown in FIG. 12, E is a Young's modulus of the cleaning blade 342, t is a thickness of the blade body of the cleaning blade 342 shown in FIG. 12, and L is a free length (a length of a region not fixed by a fixing tool 360) of the cleaning blade 342 shown in FIG. 12.

The Young's modulus (E) of the cleaning blade 342 is calculated with an expression as follows by measuring a force ΔS applied per unit cross-sectional area and a stretch Δa per unit length:

$$E=\Delta S/\Delta a.$$

In this case, ΔS is calculated as follows by using a load F, a coating thickness t of the sample, and a sample width w. Also, Δa is calculated as follows by using a sample reference length L and a sample stretch ΔL while the load is applied:

$$\Delta S=F/(w\times t), \text{ and}$$

$$\Delta a=\Delta L/L.$$

The Young's modulus is measured by using a tensile tester (a tensile tester MODEL-1605N manufactured by Aikoh Engineering Co., Ltd.).

Depression Amount d

The depression amount of the cleaning blade in the image holding body (the depression amount d shown in FIG. 12) is preferably in a range from 0.1 mm to 1.2 mm, and more preferably in a range from 0.2 mm to 1.0 mm.

Set Angle θ

A set angle (a set angle θ shown in FIG. 12) of the cleaning blade 342 with respect to the cleaning target member 31 is preferably in a range from 10° to 25°, more preferably in a range from 12° to 25°, and further preferably in a range from 15° to 25°. As long as the set angle θ is in the above-described range, toner removing performance is increased, and a force is prevented from locally acting on the surface of the cleaning target member. Hence, local wear of the cleaning target member is decreased.

As shown in FIG. 12, the set angle θ represents an angle (an acute angle) at which an imaginary line extending along a not bent portion of the lower surface 3C of the cleaning blade 342 intersects with a tangent to a point at which the imaginary line contacts the surface of the cleaning target member 31, in the state where the cleaning blade 342 is in contact with the cleaning target member 31.

Specific Examples of Image Forming Apparatus and Cleaning Device

Next, specific examples of an image forming apparatus and a cleaning device using the cleaning blade according to this exemplary embodiment are described in detail with reference to the drawing.

Figure 10:
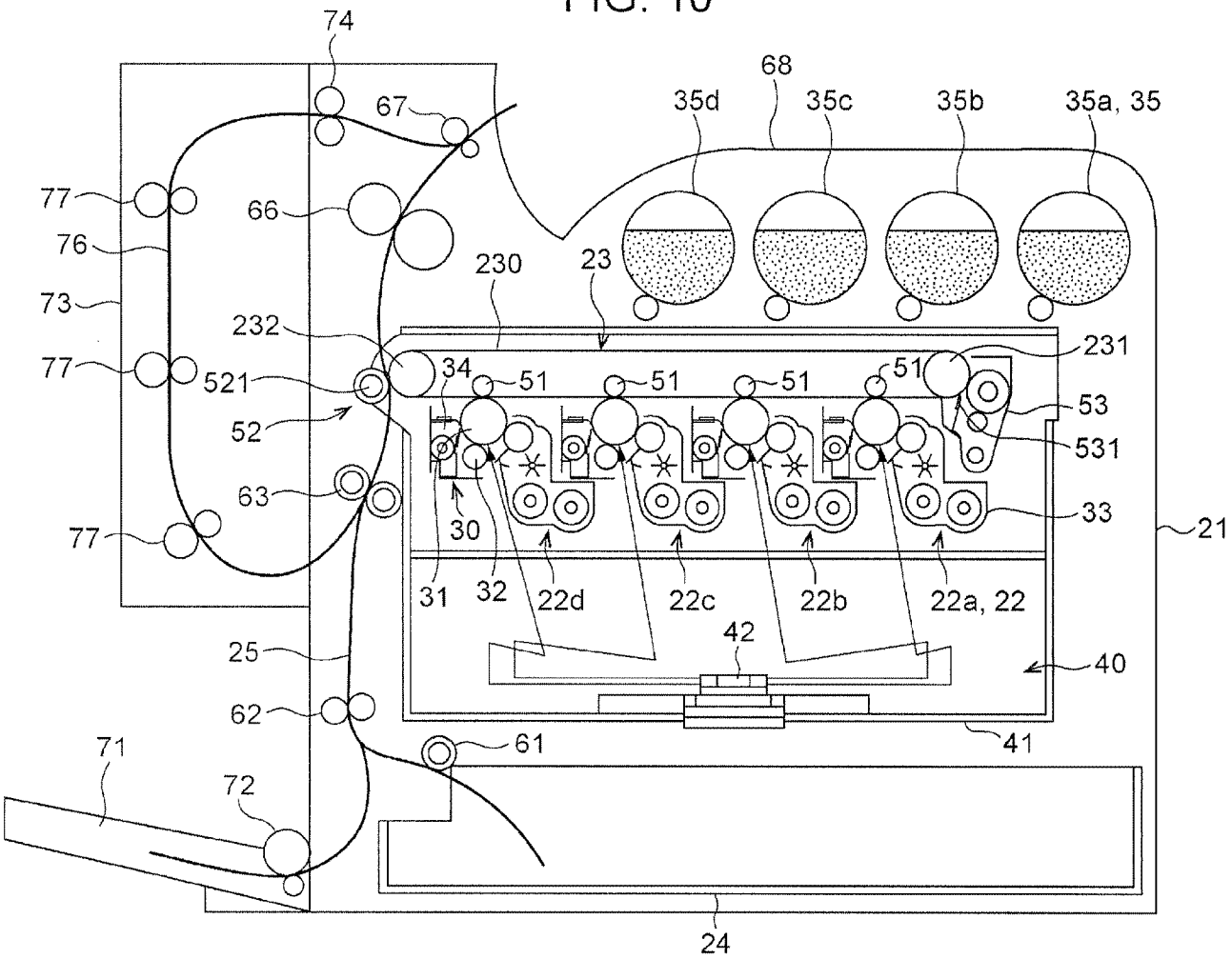
FIG. 10 schematically illustrates an example of an image forming apparatus according to this exemplary embodiment.

FIG. 10 is a schematic illustration briefly showing an example of the image forming apparatus according to this exemplary embodiment. This is a tandem image forming apparatus.

In FIG. 10, reference sign 21 denotes a body housing, 22 and 22*a* to 22*d* each denote an imaging unit, 23 denotes a belt module, 24 denotes a recording medium supply cassette, 25 denotes a recording medium transport path, 30 denotes each photoreceptor unit, 31 denotes a photoreceptor drum serving as a cleaning target member, 32 denotes a charging device, 33 denotes each developing device, 34 denotes a cleaning device, 35 and 35*a* to 35*d* each denote a toner cartridge, 40 denotes an exposure unit (an example of an electrostatic latent image forming device), 41 denotes a unit case, 42 denotes a polygonal mirror, 51 denotes a first transfer device, 52 denotes a second transfer device, 53 denotes a belt cleaning device, 61 denotes a sending roller, 62 denotes a transport roller, 63 denotes a registration roller, 66 denotes a fixing device, 67 denotes an output roller, 68 denotes a paper output unit, 71 denotes a manual supply device, 72 denotes a sending roller, 73 denotes a duplex recording unit, 74 denotes a guide roller, 76 denotes a transport path, 77 denotes a transport roller, 230 denotes an intermediate transfer belt, 231 and 232 denote support rollers, 521 denotes a second transfer roller, and 531 denotes a cleaning blade.

The tandem image forming apparatus shown in FIG. 10 includes the imaging units 22 (to be more specific, 22*a* to 22*d*) of four colors (in this exemplary embodiment, yellow, magenta, cyan, and black) arranged in the body housing 21. The belt module 23 including the intermediate transfer belt 230 is arranged above the imaging units 22. The intermediate transfer belt 230 circulates along the arrangement direction of the imaging units 22. The recording medium supply cassette 24 that houses a recording medium (not shown) such as paper is arranged in a lower section of the body housing 21. The recording medium transport path 25 serving as a transport path for the recording medium from the recording medium supply cassette 24 is vertically arranged.

In this exemplary embodiment, the respective imaging units 22 (22*a* to 22*d*) form, for example, toner images of yellow, magenta, cyan, and black in the order from the upstream side in the circulation direction of the intermediate transfer belt 230 (the arrangement is not necessarily limited to the order). The imaging units 22 include the respective photoreceptor units 30, the respective developing devices 33, and the common single exposure unit 40.

Each photoreceptor unit 30 is, for example, a sub-cartridge in which the photoreceptor drum 31, the charging device (a charging roller) 32 that preparatorily charges the photoreceptor drum 31 with electricity, and the cleaning device 34 that removes a remaining toner on the photoreceptor drum 31 are integrally arranged.

The developing device 33 develops an electrostatic latent image, formed on the electrically charged photoreceptor drum 31 by exposure to light using the exposure unit 40, with a corresponding color toner (in this exemplary embodiment, for example, having negative polarity). For example, the developing device 33 is integrated with the sub-cartridge including the photoreceptor unit 30, and hence forms a process cartridge (so-called customer replaceable unit).

Alternatively, the photoreceptor unit 30 may be separated from the developing device 33, and may form an independent process cartridge. Also, in FIG. 10, reference sign 35 (35*a* to 35*d*) denotes a toner cartridge that supplies a toner of a corresponding color component to a corresponding developing device 33 (the toner supply path is not shown).

The exposure unit 40 includes four semiconductor lasers (not shown), a single polygonal mirror 42, an imaging lens (not shown), and mirrors (not shown) corresponding to the respective photoreceptor units 30 arranged in the unit case 41, so that each polygonal mirror 42 deflects light from the semiconductor laser of a corresponding color component to provide scanning with the light, and guides a light image to an exposure point on the corresponding photoreceptor drum 31 through the imaging lens and the mirrors.

In this exemplary embodiment, the belt module 23 is formed by looping the intermediate transfer belt 230 around the pair of support rollers (one of them is a driving roller) 231 and 232. The first transfer device (in this exemplary embodiment, a first transfer roller) 51 is arranged on the back surface of the intermediate transfer belt 230 at a position corresponding to the photoreceptor drum 31 of each photoreceptor unit 30. A voltage with a polarity reverse to the charging polarity of the toner is applied to the first transfer device 51. Hence, a toner image on the photoreceptor drum 31 is electrostatically transferred to the intermediate transfer belt 230. Further, the second transfer device 52 is arranged at a portion corresponding to the support roller 232 located at the downstream side of the most-downstream imaging unit 22*d* of the intermediate transfer belt 230. The second transfer device 52 second transfers (collectively transfers) first transfer images on the intermediate transfer belt 230 to the recording medium.

In this exemplary embodiment, the second transfer device 52 includes the second transfer roller 521 arranged with a pressure toward the toner-image holding surface of the intermediate transfer belt 230, and a back-surface roller arranged at the back surface of the intermediate transfer belt 230 and forms a counter electrode of the second transfer roller 521 (in this example, the back-surface roller also serves as the support roller 232). For example, the second transfer roller 521 is grounded. Also, a bias with a polarity being the same as the charging polarity of the toner is applied to the back-surface roller (the support roller 232).

Further, the belt cleaning device 53 is arranged at the intermediate transfer belt 230, at the upstream side of the most-upstream imaging unit 22*a*. The belt cleaning device 53 removes the remaining toner on the intermediate transfer belt 230.

Also, the sending roller 61 that sends out the recording medium is provided at the recording medium supply cassette 24. The transport roller 62 that sends out the recording medium is arranged immediately downstream of the sending roller 61. The registration roller 63 that supplies the recording medium to the second transfer portion at a predetermined timing is arranged at the recording medium transport path 25 located immediately upstream of the second transfer portion. The fixing device 66 is provided at the recording medium transport path 25 located downstream of the second transfer portion. The output roller 67 that outputs the recording medium is arranged downstream of the fixing device 66. The output recording medium is housed in the paper output portion 68 formed at an upper portion of the body housing 21.

Further, in this exemplary embodiment, the manual supply device (MSI) 71 is provided at a side of the body housing 21. A recording medium on the manual supply device 71 is sent out by the sending roller 72 and the transport roller 62 toward the recording medium transport path 25.

Further, the duplex recording unit 73 is additionally provided at the body housing 21. When a duplex mode for image recording on both surfaces of a recording medium is selected, the duplex recording unit 73 reversely rotates the output roller 67, takes a recording medium, having an image recorded on one surface, into the duplex recording unit 73 by the guide roller 74 arranged in front of the entrance, transports the recording medium along the recording medium reverse transport path 76 inside the duplex recording unit 73 by the transport roller 77, and supplies the recording medium toward the registration roller 63 again.

Next, the cleaning device 34 arranged in the tandem image forming apparatus shown in FIG. 10 is described in detail.

Figure 11:
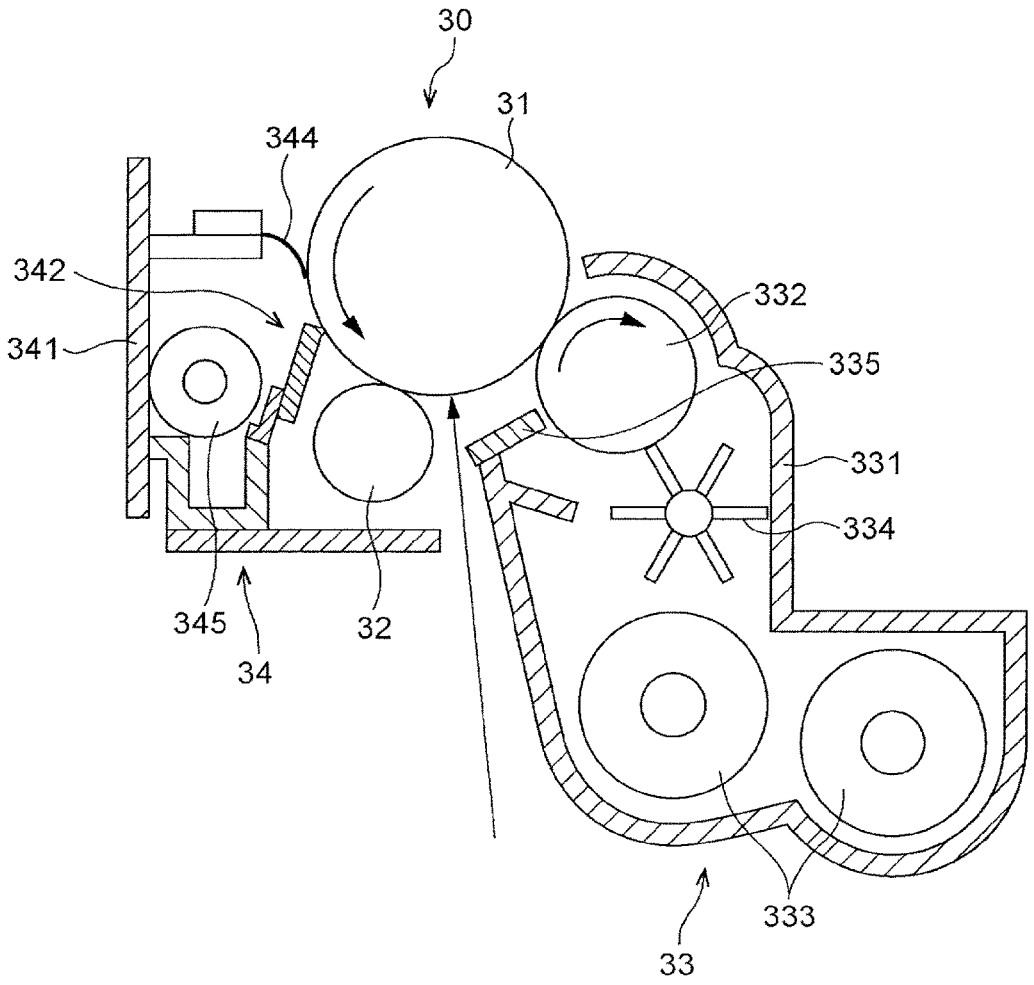
FIG. 11 is a schematic cross-sectional view showing an example of a cleaning device according to this exemplary embodiment.

FIG. 11 is a schematic cross-sectional view showing an example of the cleaning device according to this exemplary embodiment. FIG. 11 illustrates the photoreceptor drum 31, the charging roller 32, and the developing device 33 formed as the sub-cartridge with the cleaning device 34 shown in FIG. 10.

In FIG. 11, reference sign 32 denotes the charging roller (the charging device), 331 denotes a unit case, 332 denotes a development roller, 333 denotes a toner transport member, 334 denotes a transport paddle, 335 denotes a trimming member, 341 denotes a cleaning case, 342 denotes a cleaning blade, 344 denotes a film seal, and 345 denotes a transport member.

The cleaning device 34 includes the cleaning case 341 housing the remaining toner and being open to the photoreceptor drum 31. The cleaning blade 342 is mounted at a lower edge of the opening of the cleaning case 341 through a bracket (not shown). The cleaning blade 342 is arranged in contact with the photoreceptor drum 31. The film seal 344 is mounted at an upper edge of the opening of the cleaning case 341. The film seal 344 provides hermetic sealing with respect to the photoreceptor drum 31. The transport member 345 guides the waste toner housed in the cleaning case 341 to a waste toner container arranged beside the cleaning case 341.

In this exemplary embodiment, in the cleaning device 34 of any one of all the imaging units 22 (22*a* to 22*d*), the cleaning blade according to this exemplary embodiment is used as the cleaning blade 342, and in addition, the cleaning blade according to this exemplary embodiment may be used as the cleaning blade 531 used in the belt cleaning device 53.

The developing device 33 used in this exemplary embodiment includes the unit case 331 housing the developer and being open to the photoreceptor drum 31, for example, as shown in FIG. 11. The development roller 332 is arranged at a position facing the opening of the unit case 331, and the toner transport member 333 that stirs and transports the developer is arranged in the unit case 331. Further, the transport paddle 334 may be arranged between the development roller 332 and the toner transport member 333.

For development, the developer is supplied to the development roller 332 and then is transported to a development region facing the photoreceptor drum 31, for example, in a state where the trimming member 335 regulates the layer thickness of the developer.

In this exemplary embodiment, the developer used by the developing device 33 may be, for example, a two-component developer formed of a toner and a carrier, or a one-component developer formed of only a toner.

Next, an operation of the image forming apparatus according to this exemplary embodiment is described. When the imaging units 22 (22*a* to 22*d*) form single-color toner images corresponding to the respective colors, the single-color toner images are sequentially first transferred on the surface of the intermediate transfer belt 230 in a superimposed manner to coincide with original document information. Then, the second transfer device 52 transfers the color toner images, transferred on the surface of the intermediate transfer belt 230, on a surface of a recording medium. The fixing device 66 provides fixing processing on the recording medium with the color toner images transferred. The recording medium is output to the paper output portion 68.

Meanwhile, in each of the imaging units 22 (22*a* to 22*d*), the cleaning device 34 cleans the remaining toner on the photoreceptor drum 31, and the belt cleaning device 53 cleans the remaining toner on the intermediate transfer belt 230.

In such an imaging process, the cleaning device 34 (or the belt cleaning device 53) cleans the remaining toner.

The cleaning blade 342 does not have to be directly fixed to a frame member in the cleaning device 34 as shown in FIG. 11, and may be fixed through a spring member.

EXAMPLES

Examples of the invention are described below. However, the present invention is not limited to the examples.

Example 1

Pellets of polyacetal (POM, "TENAC 4060" manufactured by Asahi Kasei Corporation) are prepared. Also, the heated and molten POM is injected into a mold having a space corresponding to the shape including the blade body 342A and the blade protrusion 342B shown in FIGS. 1 to 3 (the mold is made using the shape) by using an injection molding machine (FE360S100ASE with a clamping force of 360 tons manufactured by Nissei Plastic Industrial Co., Ltd.), and cooled and solidified. Thus, a cleaning blade A1 having the shape shown in FIGS. 1 to 3 is manufactured.

Shape, Properties, and Contact Conditions

The shape and properties of the obtained cleaning blade A1 are as follows. Various properties are measured by the above-described method.

Shape of contact surface: flat surface Length of contact surface (the length in the movement direction of the surface of the photoreceptor being the cleaning target member): (described in Table 2)

Angle of contact surface (the angle in the thickness direction of the contact surface being the flat surface): 120°

Angle of end portion of inclined surface (the angle of the edge at the end portion of the inclined surface 3A opposite to the distal end surface 3B): (described in Table 2)

Distance between inclined surface and lower surface (the largest distance between the inclined surface 3A and the lower surface 3C): 5 μm Tensile modulus (elasticity modulus): (described in Table 2)

Dynamical friction coefficient μ (measurement object=PET): (described in Table 2)

Also, when the cleaning blade is arranged to contact the photoreceptor in "wear test," the contact conditions are set as follows.

Pressing force (normal force) NF: (described in Table 2)

Depression amount d: (described in Table 2)

Set angle θ: 10°

Example 2

A cleaning blade is manufactured similarly to Example 1 except that the shape, properties, and contact conditions are changed to be as described in Table 2. The cleaning blade is arranged in contact with the photoreceptor.

Example 3

The POM in Example 1 is changed to polybutylene terephthalate (PBT, "TORAYCON 1401X04" manufactured by Toray Industries, Inc.), and a cleaning blade is manufactured similarly to Example 1 except that the shape, properties, and contact conditions are changed to be as described in Table 2. The cleaning blade is arranged in contact with the photoreceptor.

Comparative Example 1

A cleaning blade B1 having a rectangular-parallelepiped shape shown in FIG. 13, that is, a shape without a blade protrusion is manufactured by the following method.

The cleaning blade is manufactured similarly to Example 1 except that the shape, properties, and contact conditions are changed to be as described in Table 2. The cleaning blade is arranged in contact with the photoreceptor.

Evaluation: Wear Test

Wear of Blade Protrusion

In evaluation for wear of the blade protrusion, each of the cleaning blades obtained by the examples and comparative example is placed in DocuCentre-IV C5575 manufactured by Fuji Xerox Co., Ltd., the contact surface of the inclined surface 3A of the blade protrusion 342B is brought into contact with the photoreceptor, and the cleaning blade is arranged with the aforementioned pressing force NF, depression amount d, and set angle θ.

Under the high-temperature high-humidity environment (28° C., 85% RH), wear of the contact surface at the protrusion of the cleaning blade and cleaning defect after image formation using A4 paper (210 mm×297 mm, P-paper manufactured by Fuji Xerox Co., Ltd.) until the integrated number of rotations of the photoreceptor reached 100K cycles (100,000 rotations) are evaluated and judged.

For the test, to make evaluation under a severe condition with low lubrication effect at the contact portion between the photoreceptor and the cleaning blade, the image coverage to be formed is set at 1%.

Then, for the depth of wear at the contact surface after the test, the maximum depth of a lack portion of the contact surface at the surface side of the photoreceptor is measured when the lack portion is observed with Laser Microscope VK-8510 manufactured by Keyence Corporation from the cross-section side of the cleaning blade.

Also, for evaluation of cleaning defect, after the aforementioned test, A3 paper with a not-transferred solid image (solid image size: 400 mm×290 mm) is supplied to the area between the photoreceptor and the cleaning blade at a normal process speed, the apparatus is stopped immediately after the trailing edge portion in the transport direction of the not-fixed image passed through the contact portion between the photoreceptor and the cleaning blade, and slip-through of toner is visually checked. If the slip-through of toner is recognized, it is judged that cleaning defect is generated. If the slip-through of toner is not recognized, it is judged that cleaning defect is not generated.

The evaluation criteria of edge wear are shown below. The allowable range is from G0 to G2.

TABLE 1

| Protrusion wear evaluation grade | Protrusion wear depth | Cleaning defect |
|---|---|---|
| G0 | 3 μm or smaller or no wear | Not generated |
| G1 | 3 μm or smaller | Not generated |
| G2 | Over 3 μm and 5 μm or smaller | Not generated |
| G3 | Over 3 μm and 5 μm or smaller | Generated |
| G4 | Over 5 μm and 10 μm or smaller | Generated |
| G5 | Over 10 μm | Generated |

Wear of Photoreceptor

For the photoreceptor wear rate, the coating thickness before the aforementioned wear test and the coating thickness after the wear test are measured by an eddy-current coating thickness gauge, and the difference therebetween is calculated, as a photoreceptor wear rate (nm/k·cycle) per 1000 cycles (1000 rotations) of the photoreceptor.

Initial Cleaning Performance Evaluation

Cleaning performance at an initial phase of image formation is evaluated by the following test.

For an image formed at an initial phase (more specifically, when the integrated number of rotations of the photoreceptor is 100 rotations) in the wear test, the presence of image defect due to the slip-through of toner at the contact portion between the cleaning blade and the photoreceptor is checked and evaluated with reference to criteria as follows:

A (○): image defect due to slip-through of toner at initial phase is not generated, and B (x): image defect due to slip-through of toner at initial phase is generated.

Comprehensive Evaluation

Comprehensive evaluation is made with reference to evaluation criteria as follows:

A (○): initial cleaning performance evaluation is A (○), wear of blade protrusion is from G0 to G2, and photoreceptor wear rate is 40 nm/K·cycle or lower; and B (x): at least one of situations that initial cleaning performance evaluation is B (x), wear of blade protrusion is from G3 to G5, and photoreceptor wear rate is higher than 40 nm/K·cycle is matched.

TABLE 2

| | Example 1 | Example 2 | Example 3 | Comparative Example 3 |
|---|---|---|---|---|
| Resin | POM | POM | PBT | POM |
| Tensile modulus [MPa] | 2900 | 2500 | 2000 | 2500 |
| Dynamical friction coefficient μ | 0.02 | 0.01 | 0.1 | 1.3 |
| Blade protrusion | Present | Present | Present | Absent (rectangular-parallelepiped) |
| Contact surface length [μm] | 10 | 60 | 30 | — |
| Inclined surface end portion angle [°] | 40 | 10 | 25 | — |
| Pressing force NF [gf/mm] | 1 | 1.2 | 1.5 | 1.2 |
| Depression amount d [mm] | 0.2 | 0.4 | 0.5 | 0.4 |
| Blade protrusion wear | G0 | G1 | G2 | G5 |
| Photoreceptor wear rate [nm/k · cycle] | 10 | 20 | 40 | 100 |
| Initial cleaning performance | A (○) | A (○) | A (○) | A (○) |
| Comprehensive evaluation | A (○) | A (○) | A (○) | B (x) |

It is found that, with each of the cleaning blades according to Examples 1 to 3 having the shapes with the blade protrusions 342B, the pressing force to the photoreceptor being the cleaning target member is decreased, the wear of the blade protrusion is small, and the wear of the photoreceptor is also small when cleaning is executed, as compared with the cleaning blade according to Comparative Example 1 having the rectangular-parallelepiped shape without the blade protrusion.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning blade configured to contact a cleaning target member having a cleaning target surface configured to move, the cleaning blade being configured to clean the cleaning target surface, the cleaning blade comprising:

a blade body having a distal end surface facing an upstream side in a direction of the movement in a state where the cleaning blade is in contact with the cleaning target member, a lower surface facing a downstream side in the direction of the movement in the state where the cleaning blade is in contact with the cleaning target member, an upper surface sharing a side with the distal end surface and opposed to the lower surface, and a pair of side surfaces each sharing sides respectively with the distal end surface, the lower surface, and the upper surface; and a blade protrusion that, when a direction in which the pair of side surfaces are opposed is a width direction, a direction in which the lower surface and the upper surface are opposed is a thickness direction, and a direction orthogonal to the width direction and the thickness direction is a height direction, is present at an end portion of the lower surface near the distal end surface, has a shape protruding outward in the thickness direction with respect to the lower surface, and has an inclined surface being a surface continued from the distal end surface and inclined outward in the thickness direction with respect to the lower surface and inward in the height direction with respect to the distal end surface from an end of the distal end surface near the lower surface, wherein at least a portion of the inclined surface is a contact surface configured to contact the cleaning target member, wherein an end of the inclined surface opposite to the distal end surface is provided a predetermined distance from the lower surface.

2. The cleaning blade according to claim 1, wherein the contact surface has a length in the direction of the movement of the cleaning target surface, in a range from about 10 μm to about 60 μm.

3. The cleaning blade according to claim 1, wherein the contact surface has a length in the direction of the movement of the cleaning target surface, in a range from about 10 μm to about 50 μm.

4. The cleaning blade according to claim 1, wherein the contact surface has a length in the direction of the movement of the cleaning target surface, in a range from about 10 μm to about 40 μm.

5. The cleaning blade according to claim 1, wherein an angle indicated by a requirement (a) or a requirement (b) is in a range from about 95° to about 140°, the requirements (a) and (b) being the requirement (a): an angle of the contact surface with respect to the thickness direction when the contact surface is a flat surface, and the requirement (b): an angle of a tangent to the cleaning target surface at an end near the distal end surface of a region where the contact surface contacts the cleaning target surface, with respect to the thickness direction, when the cleaning target surface is a curved surface and the contact surface is a curved surface having a curvature radius corresponding to a curvature radius of the cleaning target surface.

6. The cleaning blade according to claim 5, wherein the angle indicated by the requirement (a) or (b) is in a range from about 100° to about 135°.

7. The cleaning blade according to claim 5, wherein the angle indicated by the requirement (a) or (b) is in a range from about 105° to about 130°.

8. The cleaning blade according to claim 1, wherein the cleaning blade is formed of a resin composition containing thermoplastic resin as a major component.

9. The cleaning blade according to claim 8, wherein the thermoplastic resin is crystalline resin.

10. The cleaning blade according to claim 9, wherein the crystalline resin is polyacetal.

11. A process cartridge configured to be removably mounted on an image forming apparatus, the process cartridge comprising a cleaning device including the cleaning blade according to claim 1.

12. An image forming apparatus comprising:

an image holding body;

a charging device configured to charge a surface of the image holding body with electricity;

an electrostatic latent image forming device configured to form an electrostatic latent image on the electrically charged surface of the image holding body;

a developing device configured to develop the electrostatic latent image formed on the surface of the image holding body with a developer containing a toner, and configured to form a toner image;

a transfer device configured to transfer the toner image on a surface of a recording medium; and a cleaning device configured to include the cleaning blade according to claim 1, bring the cleaning blade into contact with the image holding body, and clean the surface of the image holding body.

13. The cleaning blade according to claim 1, wherein the blade protrusion has a shape in which the end of the inclined surface opposite to the distal end surface is acutely bent toward the lower surface.

14. The cleaning blade according to claim 1, wherein the blade protrusion has a shape in which the end of the inclined surface opposite to the distal end surface is obtusely bent toward the lower surface.

15. The cleaning blade according to claim 1, wherein the blade protrusion has a shape in which the end of the inclined surface opposite to the distal end surface is bent a plurality of times toward the lower surface.

16. The cleaning blade according to claim 1, wherein the blade protrusion has a shape in which the end of the inclined surface opposite to the distal end surface is a curved surface smoothly continued from the inclined surface to the lower surface.

17. The cleaning blade according to claim 1, wherein an angle of an edge present at the end of the inclined surface opposite to the distal end surface is 10° or larger.

18. The cleaning blade according to claim 1, wherein the predetermined distance is 20 μm or smaller.

19. The cleaning blade according to claim 1, wherein the predetermined distance is 0.1 μm or larger.

* * * * *